US007487820B2

(12) United States Patent
Mutsaarts

(10) Patent No.: US 7,487,820 B2
(45) Date of Patent: Feb. 10, 2009

(54) METHOD FOR DETERMINING REUSE OR DISPOSAL OF A REFRACTORY PLATE AND DEVICE THEREFOR

(75) Inventor: Philippe Mutsaarts, Obourg (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 10/565,480

(22) PCT Filed: Jul. 20, 2004

(86) PCT No.: PCT/BE2004/000106

§ 371 (c)(1),
(2), (4) Date: Jan. 20, 2006

(87) PCT Pub. No.: WO2005/007325

PCT Pub. Date: Jan. 27, 2005

(65) Prior Publication Data

US 2006/0249274 A1 Nov. 9, 2006

(30) Foreign Application Priority Data

Jul. 22, 2003 (EP) ..... 03447192

(51) Int. Cl.
*B22D 11/10* (2006.01)
*B22D 41/28* (2006.01)
*B22D 46/00* (2006.01)

(52) U.S. Cl. ..... 164/457; 164/488; 164/437; 164/337; 222/594

(58) Field of Classification Search ..... 164/483, 164/488, 155, 449, 4.1, 457, 437, 337; 222/594, 222/606

See application file for complete search history.

(56) References Cited

U.S. PATENT DOCUMENTS

| | | | | |
|---|---|---|---|---|
| 4,355,787 | A | 10/1982 | Hannes et al. | |
| 4,583,717 | A | 4/1986 | Hasegawa et al. | |
| 4,770,230 | A * | 9/1988 | Tinnes et al. | 164/483 |
| 5,772,908 | A * | 6/1998 | Richard | 222/594 |
| 5,893,492 | A * | 4/1999 | Hanse et al. | 222/590 |
| 2005/0242094 | A1 | 11/2005 | Gerber et al. | |

FOREIGN PATENT DOCUMENTS

| | | |
|---|---|---|
| EP | 817692 B1 | 1/1998 |
| JP | 2003181625 | 7/2003 |
| WO | WO 97/15410 | 5/1997 |

* cited by examiner

*Primary Examiner*—Kevin P Kerns
(74) *Attorney, Agent, or Firm*—Thomas J. Clinton; Donald M. Satina

(57) ABSTRACT

A method for deciding objectively whether a refractory plate of a slide gate valve used to control the flow of a molten metal during the pouring of the metal from an upper vessel to a lower vessel can be reused or should be discarded. Values of parameters measured during pouring or proper to the plate are determined during successive uses of the plate. The values are compared to threshold values to reach a decision. Also, a device for making decisions according to this method.

12 Claims, 2 Drawing Sheets

METHOD FOR DETERMINING REUSE OR DISPOSAL OF A REFRACTORY PLATE AND DEVICE THEREFOR

FIELD OF THE INVENTION

The present invention has for its main object a systematic method allowing a user to decide objectively whether a refractory plate of a slide gate valve used to control the flow of a molten metal during the casting of said metal from a upper vessel to a lower vessel can be reused or should be discarded. According to another of its aspects, the invention relates to a device intended for carrying out the above-described method.

BACKGROUND OF THE INVENTION

In the casting, particularly the continuous casting, of a liquid in the liquid state from an upper metallurgical vessel toward a lower vessel, it is necessary to ensure a certain level of control on the metal flow and in particular on the casting flow rate. Various means used to this end are known: internal means such as a stopper or external means such as the slide gate valve (linear or rotary).

Most slide gate valves comprise a set of refractory plates, each provided with at least one pouring orifice, inserted in a device permitting a relative displacement of the plates while ensuring their compression so that the metal stream could more or less easily flow through the orifices of adjacent plates depending on the throttling rate of the orifices. In the known devices, the relative displacement of the plates (at least one of them being mobile and at least one being fixed or stationary) is carried out according to a linear, rotary or any other trajectory translation move. The relative displacement of the plates is generally ensured by the force exerted by a cylinder (hydraulic, pneumatic or electromechanical) or even by a motorized driving device. Throughout the casting, the throttling rate of the plates is continuously adjusted so as to maintain the casting conditions (flow rate, metal level in the upper vessel, etc.) in suitable limits.

Such slide gate valves can be operated for casting from a furnace towards a ladle or a converter, from a converter toward a ladle or from a ladle toward a tundish. The present invention relates to these different possibilities. For the sake of conciseness, it will however mainly be described in the context of casting from a ladle toward a tundish.

During the casting operations, the refractory plates are subjected to many severe stresses which, in the long run, are responsible for their wear. In particular, these are thermal (high casting temperature), chemical (composition of the cast metal, of the slag), mechanical (level of the throttling, number of relative displacements, etc.), thermo-mechanical (thermal shock), etc. stresses. Further, certain events or incidents occurring during the casting operation might have a significant impact on the state of the refractory plates. For example, in the case of non-natural opening of the upper vessel or in the case of clogging of the orifice during the casting, it might be necessary to use a torch or other thermal rods in order to clear the pouring orifice of the plate. Such recourse to a torch is obviously disastrous as to the state of the plate. All these stresses generate radial wear of the pouring orifice, an erosion of the throttling lips (portion of the orifice periphery used to perform the throttling of the liquid metal stream), cracks of all kinds, more or less important disintegration or melting of the refractory material or even the penetration of foreign bodies inside the refractory material.

These last years, the quality of the refractory materials used for the manufacture of such plates as well as the optimization of their shape has permitted a considerable increase in their life time so that after a first use in a slide gate valve during the casting from an upper vessel towards a lower vessel, it is actually possible to reuse these plates a certain number of occurrences.

After each use of a refractory plates set, it is therefore necessary to decide whether these plates can be reused or must be discarded. The method generally practiced in the metallurgical industry consists in performing a visual inspection of the refractory plates, the decision resting essentially on the appearance of the plates. This visual inspection is performed at the level of the so-called "maintenance" zone (for the metallurgical vessels) where the metallurgical vessels are laid down so as to permit an easy access to the slide gate valve. It will be noted that this preparation zone is often far remote from the casting zone where the actual casting operations are performed so that, practically very little information is exchanged between the operators of these different zones.

The conditions of performing the visual inspection of the plates are far from being optimal. The plates are indeed only visible through the pouring orifice; therefore, this does not allow the inspection of the state of the sliding surfaces where the degradations are the most important. In most of the cases, the partial dismantling of the gate on this occasion is prohibited since it generates an over-consumption of manpower and a significant loss of time and especially since such a dismantling generates a very significant thermal shock at the level of the plates.

The visual inspection of the plates is therefore performed by an operator having a certain expertise in this particular field, since his decision as to the possible reuse or rejection of a refractory plate is crucial. The reuse of a deteriorated plate can indeed cause a very serious accident (breakage) which can compromise the safety of the operators or, at least, very seriously damage the casting installation. On the other hand, the premature rejection of a plate causes significant economic (increase of the reduction costs) and environmental damages. This decision is very subjective and depends largely upon the experience and the skill of the operator.

JP-A-2003181625 describes a method of measure of the wear level of the plates of a slide gate valve used to control the flow of a molten metal. The wear level is determined with the help of a specific tool. An end of the tool is connected to the casting orifice of the plate for a direct measure. Each new plate must be equipped with such a tool.

SUMMARY OF THE INVENTION

According to a first of its objects, the present invention has therefore for an object a method permitting a user to decide objectively whether a refractory plate of a slide gate valve used to control the flow of a molten metal during the casting of said metal from an upper vessel to a lower vessel can be reused or must be rejected. This method uses data which are normally available and measured in the casting installations as well as typical parameters of the actual plate wear such as the throttling rate.

It will be noted that in the scope of the present invention, when reference is made to the wear of a plate, actually, this is the wear of a working face of a plate which is considered since, when the plate has two working faces, it can be possible to use independently the two faces of a plate as described in the patent EP-B1-817692.

The method according to the invention is characterized by the fact that the decision whether to reuse or reject the refractory plate is based on a set of parameters determined, calculated or measured during successive uses of the plate and which are then compared, at the time of taking the decision, to threshold values.

The threshold values are determined in function of the local conditions of use, for example, in function of the actual installation, the casting process, the quality of the cast metal and the acceptable safety margin.

The parameters determined, measured or calculated during the casting are typical of the actual plate wear and take into account the history of the plates by integrating data concerning various events or incidents that occurred during their use. This method integrates a certain number of variables which are normally available in the casting installation (metal weight in the upper vessel for example).

According to a first embodiment of the present invention, the method is based on the instant determination of the wear of the plates.

According to a first variant of this particular embodiment of the invention, the method determines the wear of the throttling lips of the plates by the calculation of the difference between the measured throttling rate of the valve and the throttling rate calculated by the laws of physics. This difference between the throttling rate can be compared to a threshold value beyond which a decision to reject the plates must be taken.

The actual throttling rate can be measured, for example, with a transducer connected to the plate displacement device indicating the relative plate displacement. Moreover, the theoretical throttling rate can be calculated easily by the following method. It is also possible to calculate the cross-section surface of the liquid metal passage corresponding to an instant measured flow rate and to a ferrostatic pressure that is calculated as a function of the instant weight of the metal in the upper vessel and the inner geometry of said vessel. For a given casting orifice diameter (new plate or worn plate), this cross-section passage corresponds to a theoretical throttling rate. The difference between the values of the measured and theoretical throttling rate provides a measure of the wear. Thus, the difference of throttling rates can be expressed in terms of length corresponding to the worn parts of the lips. This length can then be compared to a maximum length beyond which the plates must be discarded.

According to a variant of this particular embodiment of the invention, the method evaluates the wear by the calculation of the difference between the actual flow rate calculated for an instant position of the valve measured by an appropriate device for an instant ferrostatic pressure calculated in function of the instant metal weight and the inner geometry of the upper vessel at a given time, for a given diameter of the pouring orifice (new plates or worn plates) and the same flow rate as calculated according to the laws of physics. This difference of flow rate can also be compared to a threshold value beyond which a decision to reject should be taken.

According to another variant, the method evaluates the radial plate wear by calculating the difference between the actual flow rate measured when the gate is fully opened, for an instant ferrostatic pressure calculated in function of the instant metal weight and of the inner geometry of the upper vessel at this time and the flow rate calculated according to the laws of physics in the same conditions. This difference of flow rate can also be compared to a threshold value beyond which a decision to reject can be taken.

According to yet another variant of this embodiment, the method can take into account the energy (hydraulic pressure or electrical current) used for sliding the mobile plate. This measure gives a representation of the roughness of the sliding surface of the mobile plate with respect to the fixed plate or the fixed plates (i.e., an image of the wear of the contact surface of the plates) and the mechanical state of the system or, more generally, an image of the alteration of the characteristics of relative displacement of the plates. A threshold for the rejection or inspection of the plates and the gate can be considered.

According to a second embodiment of the invention, the method integrates the time of use of the plates in wearing condition. In other words, the time elapsed during which the refractory plates have actually been subjected to wear is taken into account. To this end, it is necessary to deduce from the total casting time, the time of full closing and the time of full opening since, in these two positions, the plates are subject to little or no wear. It must be understood that the time of use of the plates in wearing condition cumulates all the times elapsed during successive uses of the plates. The method according to the invention comprises therefore a step of comparison of the time of use of the plates in wearing conditions with a threshold value.

According to a variant of this embodiment of the present invention, the number of relative moves (linear or rotary) performed by the plates is counted. This number of moves can also be compared to a threshold value beyond which a decision to reject the plate should be taken.

According to an advantageous variant of the same embodiment, the precision of the decision is improved by integrating the times related to incidents. It can be observed that in case of non-natural opening of a metallurgical vessel requiring the use of the devastating action of a torch, the number of necessary torches and consequently, the intensity and duration of the clearing process under the action of a torch—and thus the resulting plates wear—are directly proportional to the time during which the plate remained blocked. Henceforth, it is possible to take into account a non-natural opening by multiplying the non-operating time (thus the time during which the pouring orifice of the plate remained blocked) by a given factor (for example a factor 4). This taking into account can still be improved by deducing the average time elapsed before the intervention by the operators of the torch (for example 2 minutes). It is also possible to take into account the time of inactivity of the plates between two successive uses which cannot exceed a certain value.

On the basis of the same principle, it is also possible to take into account the blocking of the pouring orifice that occurred during the casting. Such an event generally requires taking extremely severe measures so as to restart the casting operations. Henceforth, a blocking of the casting orifice can be taken into account by multiplying the blocking time (thus the time during which the plate orifice remained blocked) by a given factor (for example a factor 8).

According to a related embodiment, the method takes into account any metal leakage between the plates (that can be connected to the fact that the gate being completely closed, a residual metal flow is still present). Since it is a very serious incident which can lead to endangering the casting installation, the method provides a signal of immediate rejection of the refractory.

According to a variant of the invention, each of the events or incidents is allotted a seriousness indicia. By integrating each of the events or incidents, as weighted by its seriousness indicia, a value typical to the events or incidents occurred is obtained and this value can be compared to a threshold value beyond which a decision to reject the plate must be taken.

According to a third particularly advantageous embodiment, the method for the decision integrates two or more of the embodiments (and their variants) hereabove described: as soon as one of the values compared to its corresponding threshold value is exceeded, a decision to reject the plate is taken. Eventually, in this case, an "indecision zone" is reached, corresponding to a situation where none of the threshold values has been exceeded, but where these values are approached for at least two of the variables. When the method leads to an indecision, it can be decided to have recourse to a visual inspection.

According to another of its aspects, the invention relates to a device for carrying out the above-described method. It is thus a device for taking a decision to reuse or reject a refractory plate of a slide gate valve used for the control of the flow of a molten metal during the casting of said metal from an upper vessel towards a lower vessel, the device comprising an input unit connected to sensors, detectors or counters for introducing the selected variables, a unit for the memorization of the threshold values and a calculation unit able to perform operations on the variables introduced through the input unit and to compare the parameters or the results of said operations on these parameters to the threshold values and an output unit able to emit a signal corresponding to the decision whether to reuse or reject.

Advantageously, the device memorizes also the various parameters relating to a set of plates during its successive uses. To this end, it is preferable that each set of plates be univocally identified. This can be performed by identifying the set of plates for example with a bar code. When the set of plates is introduced into the slide gate valve installed on a given casting vessel, the set of plates no longer visible, it becomes necessary to also identify univocally this vessel so that (thanks to a link between the identifiers of the set of plates and casting vessel), the information pertaining to a set of plates can be found from the identifier of the upper vessel.

It will be noted that the various units of the devices can be far remote one from the others; as the casting zone can be far remote from the maintenance zone. Henceforth, it is also advantageous that the signal emissions between the different units be performed by a computer network, by telephony or by a hertzian network.

Eventually, it will be noted that the information generated by carrying out the method according to the invention can also be exploited in the frame of the management of the plate consumption and reordering.

DETAILED DESCRIPTION OF THE INVENTION

Figure 1:
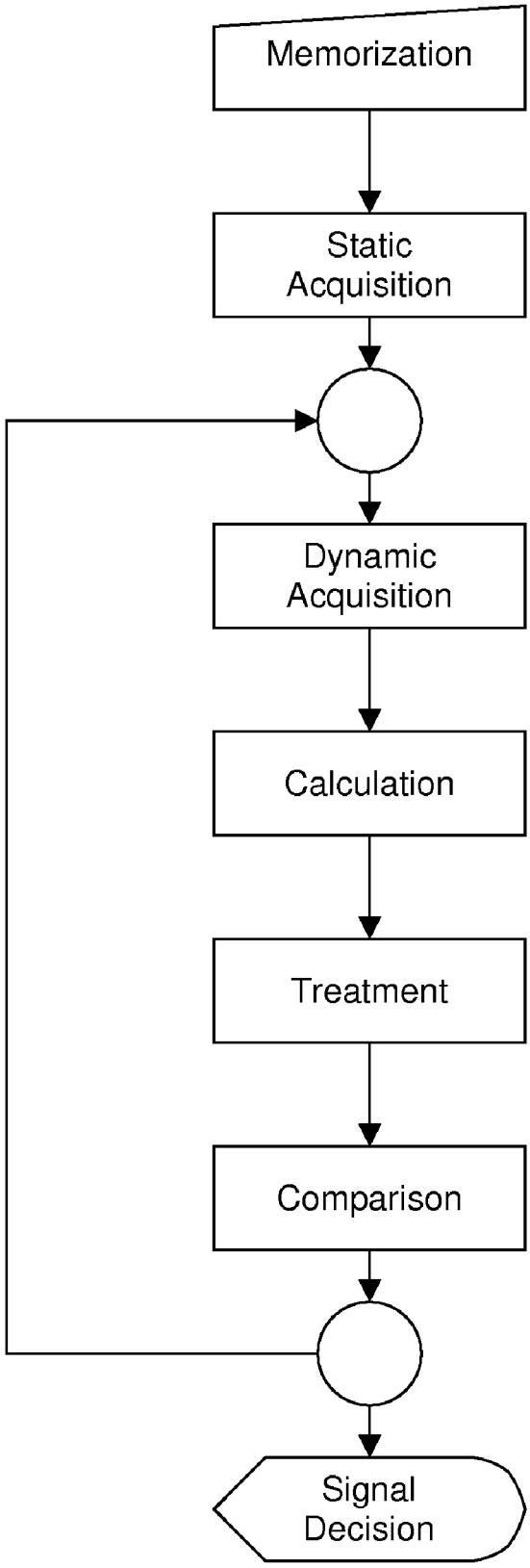
FIG. 1 is a schematic representation of the method according to the invention.

The invention will now be described with reference to FIGS. 1 and 2. A schematized version of the method according to the invention applied to a steel continuous casting ladle equipped with a hydraulically driven slide gate valve has been depicted in FIG. 1. The memorization step consists in this case of entering into the memorization unit the different threshold values which have been retained. For example, the casting time values, the number of relative moves and the lips wear beyond which a decision to reject must be taken or beyond which a visual inspection is recommended are set. The coefficients related to the incidents (blocking, plugging, leakage, . . . ) are also set at this stage as well as, if necessary, the seriousness indicia. These values can be entered manually, but preferably the device retrieves them from a library, taking into account the local conditions of use.

The step of static acquisition consists in entering the information relating to the ladle (inner geometry) and to the set of plates being the object of the decision through the input unit of the system.

The next four steps are performed during the casting operations. The step of dynamic acquisition comprises the acquisition, during all the casting operations of the different values of the retained parameters. For example, the casting time of the ladle along the pouring, the instant weight of the ladle, the number of moves, the hydraulic pressure of the cylinder, the instant position of the cylinder end, etc.

The calculation step comprises the calculation of the different values which are not acquired directly by the system but which can be determined from the acquired values. It can be the flow rate (instant variation of the metal weight in the ladle), the inner geometry of the ladle (calculated from the original geometry taking into account the theoretical wear of the lining), the ferrostatic pressure (calculated from the instant geometry and the metal weight in the ladle), the difference between the measured position of the cylinder and the theoretical position, the instant difference between the measured flow rate and the theoretical flow rate, etc.

The treatment step comprises the determination of the different incidents (blocking, plugging, leakage) from the previously acquired variables.

Eventually, the comparison step consists in comparing the so determined or acquired variables with the threshold values contained in the memorization unit. These four last steps are repeated all along the pouring of the ladle.

When the ladle leaves the casting zone, the last step of decision is performed. The system emits a signal (visual or sound) corresponding to a decision to reject or reuse or to a suggestion to proceed to a visual inspection.

Figure 2:
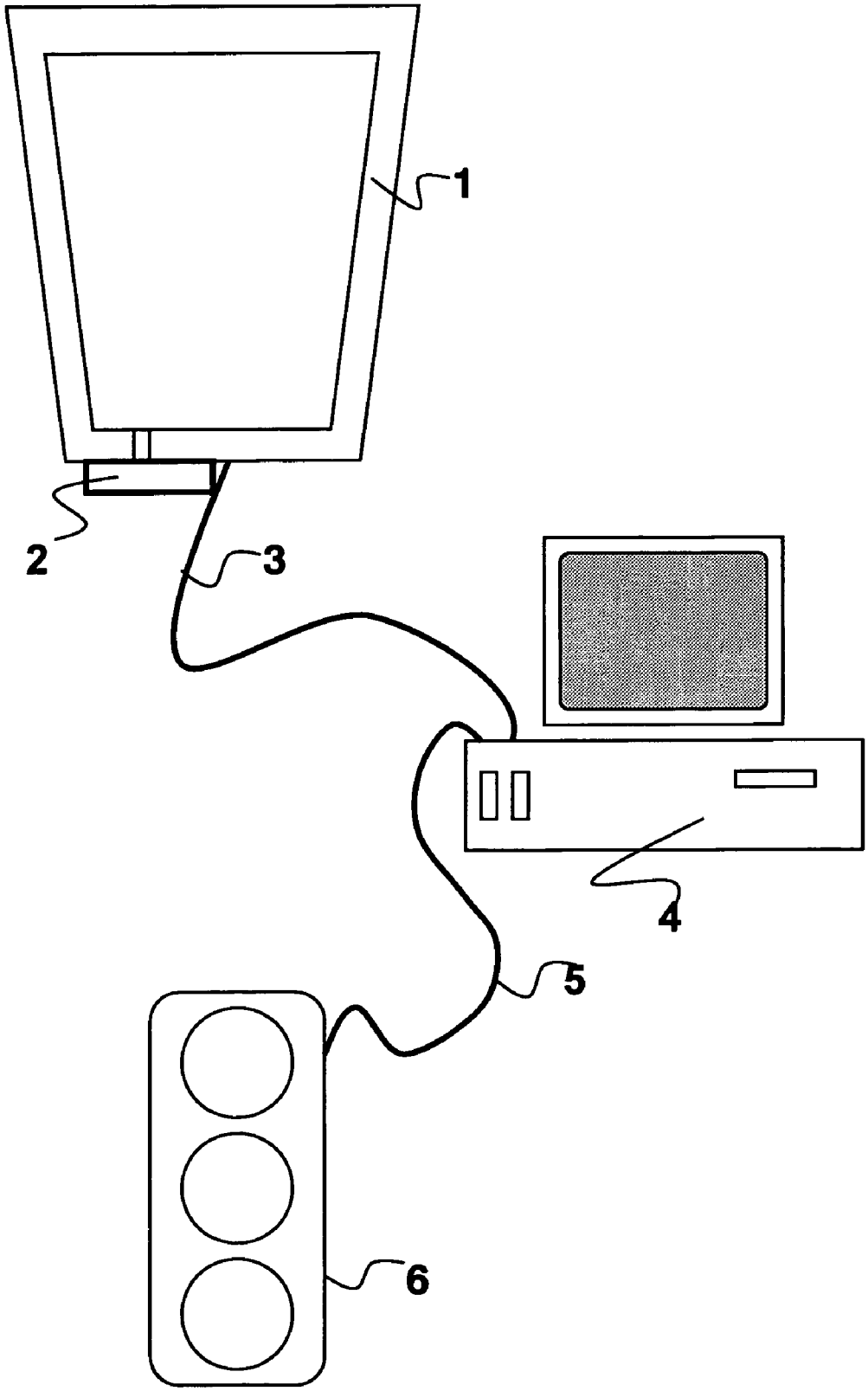
FIG. 2 is a diagram of the physical components of a device according to the invention.

In FIG. 2, a device allowing the implementation of this process has been depicted. A ladle 1 in the casting zone has been depicted. The ladle is equipped with a linear or rotary slide gate valve 2 and is connected to a device 4 for taking a decision through connection 3. The device 4 itself comprises a memorization unit, one (or more) acquisition, calculation, treatment and output unit(s). Eventually, the device 4 is connected to an output device 6 (represented here by traffic lights) by a connection 5. The connection represented here by a line can be realized by cable, by the hertzian way or otherwise. Preferably, the output device 6 will be located in the maintenance zone of the ladle.

The invention claimed is:

1. Method for deciding whether to reuse or reject a refractory plate of a slide gate valve used for control of flow of a molten metal during pouring of said metal from an upper vessel towards a lower vessel, said plate having a plate use history, said method comprising: identifying a set of parameters, at least one of said parameters being measured during the pouring and at least one of said parameters being proper to the plate; determining values of the parameters during successive uses of the plate; comparing the determined values to threshold values; and deciding to reuse the plate if the determined values do not reach the threshold values, and deciding to reject the plate if the determined values exceed the threshold values.

2. The method of claim 1, wherein the refractory plate is configured to be displaced within the slide gate valve by a valve cylinder having a valve cylinder end, and wherein the parameter measured during pouring is selected from the group consisting of:

a) pouring flow rate, b) relative plate displacement,
c) position of the valve cylinder end,
d) hydraulic pressure on the valve cylinder,
e) pressure exerted by the molten metal in the upper vessel,
f) weight exerted by the molten metal in the upper vessel,
g) geometry of the upper vessel,
h) energy used for sliding the refractory plate,
i) total pouring time,
j) time of full closing of the slide gate valve,
k) time of full opening of the slide gate valve, and
l) number of relative moves performed by the refractory plate.

3. Method according to claim 1 wherein the threshold values are set in relation to local conditions of use.

4. Method according to claim 1 wherein the decision is based on instant determination of plate wear.

5. Method according to claim 4 wherein the refractory plate comprises throttling lips, and wherein instant wear of the throttling lips of the plate is determined by a calculation of the difference between a measured throttling rate of the valve and a calculated throttling rate.

6. Method according to claim 4 wherein the refractory plate comprises throttling lips, and wherein instant wear of the throttling lips is determined by the calculation of a difference between an actual flow rate calculated for an instant position of the valve measured by an appropriate device for an instant ferrostatic pressure calculated as a function of instant metal weight and inner geometry of the upper vessel at a given time, for a given diameter of the pouring orifice and a flow rate as calculated theoretically.

7. Method according to claim 4 wherein radial wear of the plate is determined by calculating a difference between an actual flow rate measured when the slide gate valve is fully opened, for an instant ferrostatic pressure calculated as a function of instant metal weight and of inner geometry of the upper vessel at this time and a flow rate calculated theoretically in the same conditions.

8. Method according to claim 4 wherein an alteration of the characteristics of relative displacement of the plates is determined on the basis of energy used for the relative displacement of the plates.

9. Method according to claim 1 wherein the plate use history is taken into account in the decision.

10. Method according to claim 9 wherein events and incidents that occurred during the pouring are taken into account in the decision.

11. Method according to claim 1 wherein the decision is based on an instant determination of the plate wear taking into account the plate use history.

12. An apparatus for deciding whether to reuse or reject a refractory plate of a slide gate valve used for control of flow of a molten metal during pouring of said metal from an upper vessel towards a lower vessel, comprising a slide gate valve configured to house a refractory plate;

a measurement device, linked to the slide gate valve, configured to accept a measurement from the slide gate valve;

an input unit configured to accept selected variables, a memory unit, linked to the measurement device and the input unit, configured to store a measurement, variables, and threshold values, a calculation unit, linked to the memory unit, configured to perform operations on the measurement accepted from the slide gate valve and the variables introduced through the input unit and to compare results of operations on the measurements and variables to the threshold values to produce a decision to reuse the plate if the results of the operations do not reach the threshold values, or reject the plate if the results of the operations exceed the threshold values, and an output unit, linked to the calculation unit, configured to emit a signal corresponding to the decision whether to reuse or reject the plate.

* * * * *